US006321412B1

(12) United States Patent
Duco

(10) Patent No.: US 6,321,412 B1
(45) Date of Patent: Nov. 27, 2001

(54) DOOR KNOB STOP

(76) Inventor: Michael J. Duco, 6133 Craig Ave., Bensalem, PA (US) 19020

( * ) Notice: Subject to any disclaimer, the term of this patent is extended or adjusted under 35 U.S.C. 154(b) by 0 days.

(21) Appl. No.: 09/441,090

(22) Filed: Nov. 16, 1999

(51) Int. Cl.[7] ..... E05C 1/10
(52) U.S. Cl. ..... 16/85; 16/86 R; 292/DIG. 15
(58) Field of Search ..... 16/85, 86 R, 86 A, 16/82; 292/181, DIG. 15, 34.12

(56) References Cited

U.S. PATENT DOCUMENTS

| | | | | |
|---|---|---|---|---|
| D. 324,170 | | 2/1992 | Owens et al. . | |
| 1,211,480 | * | 1/1917 | Newton | 16/85 |
| 1,514,845 | * | 11/1924 | Fischer | 16/85 |
| 2,479,597 | * | 8/1949 | Anton | 16/85 |
| 3,133,758 | | 5/1964 | Wells . | |
| 4,462,623 | * | 7/1984 | Grant | 292/DIG. 15 |
| 5,722,115 | | 3/1998 | Arens . | |
| 5,761,766 | | 6/1998 | Basham . | |
| 5,806,908 | | 9/1998 | Kim . | |

* cited by examiner

*Primary Examiner*—Lynne H. Browne
*Assistant Examiner*—John R. C. Hingham
(74) *Attorney, Agent, or Firm*—Siemens Patent Services, LC

(57) ABSTRACT

A door stop for hollow walls having two drywall surfaces. The door stop comprises a cylindrical housing having an outwardly turned flange serving as a trim plate engaging the drywall surface exposed to the door knob of a swinging door. The flange is located at the exposed end of the housing. A piston occupies and is entrapped within a chamber formed in the housing. The piston is exposed to the door knob and presents surface roughly flush with the outer surface of the wall. The piston receives impacts when the door is swung so that the door knob strikes the wall. A spring inside the housing decelerates the piston responsive to the door being swung until contact with the wall ensues, and subsequently returns the piston to its original position. The chamber of the housing communicates to the exterior by a small orifice, so that piston movement is pneumatically dampened. A brace formed at the rear of the housing contacts the other drywall surface of the wall, such that impact forces are distributed over both drywall surfaces of the wall. The brace, which in alternative embodiments is selectively C-shaped or cruciform, is friction fit the rear wall of the housing.

12 Claims, 2 Drawing Sheets

DOOR KNOB STOP

BACKGROUND OF THE INVENTION

1. Field of the Invention

The present invention relates to devices for absorbing and dissipating forces generated by swinging doors and for protecting walls and partitions of buildings. The novel device is installed in a wall or partition in a location assuring that a door knob of a door will strike the novel device when the door is swung open with force. The invention is usable both in new construction and in retrofit applications for most residential, commercial, industrial, and institutional buildings wherein doors are not restrained and could damage either themselves or a wall or partition in the way if swung open with excessive force. The invention is particularly suited for repairs of walls and partitions built from drywall, wherein prior contact of a door knob with the drywall has formed a depression or hole therein.

2. Description of the Prior Art

Most doors in residential, commercial, industrial, and institutional buildings are mounted so as to be able to swing about a vertical axis. When the door is opened, if no apparatus is provided to limit swing of the door, the full momentum of the door may be imposed on a wall or partition where the door knob strikes that wall or partition. This will obviously damage the wall, the door, or both. This is a notoriously well known problem which has resulted in prior art attempts to solve the problem.

One approach has been to mount a receptacle within the wall or partition. This approach is seen in U.S. Pat. No. 3,133,758, issued to Malcolm B. Wells on May 16, 1964. The receptacle of Wells lacks a coil spring disposed to resist momentum of the door and a pneumatic damping chamber, both seen in the present invention. Also, Wells lacks a brace which abuts the side of a hollow wall opposite that in which the novel door knob stop is mounted.

U.S. Pat. No. 5,722,115, issued to Richard Arens on Mar. 3, 1998, is similar to the device of Wells, and also lacks the coil spring, pneumatic damping chamber, and brace of the present invention.

U.S. Design Pat. No. 324,170, issued to R. Larry Owens et al. illustrates a combined door stop and wall patch which lacks the coil spring, pneumatic damping chamber, and brace of the present invention.

A second approach is to provide a door stop which projects from the wall. This is seen in U.S. Pat. No. 5,761,766, issued to William E. Basham on Jun. 9, 1998. The door stop of Basham lacks a pneumatic damping chamber and a flush mounting flange, both being features of the present invention. The door stop of Basham lacks the brace of the present invention.

Another device generally corresponding to a door stop is shown in U.S. Pat. No. 5,806,908, issued to Yong Pyo Kim on Sep. 15, 1998. This device requires one component mounted on one of the members which collide and a second component mounted on the other one of the colliding members. By contrast, the present invention requires only one component. Also, the devices of Kim are surface mounted, whereas the present invention has a flange for flush mounting in a wall. A further difference is that a resilient solid member absorbs energy in the device of Kim, whereas this is accomplished by a pneumatic damper in the present invention. Neither component of Kim's device contacts two supporting surfaces, as do the mounting flange and brace of in the present invention.

None of the above inventions and patents, taken either singly or in combination, is seen to describe the instant invention as claimed.

SUMMARY OF THE INVENTION

The present invention provides a door stop which dissipates the momentum of a swung door and which is readily installed in a hollow door typical of walls and partitions built from drywall sheets mounted on studs. Hereinafter, such walls and partitions will be called walls. In particular, the invention is readily installed in a wall after a hole has been formed by a collision between the door knob and the wall.

Structure of the present invention includes an annular housing having an outwardly projecting flange for covering the outer surface of the wall being protected. The flange performs several functions. One function is to provide a supporting surface distributing force of impact over the front surface of the wall. A second function is aesthetic, in that the flange conceals potentially objectionable damage which may be present in drywall from prior impacts. A third function is to limit penetration of the annular housing of the door stop into the wall. A fourth function is to form the walls of a chamber which develops pneumatic pressure when dissipating force of impact of the door being protected.

A second supporting member is provided by a brace fixed to the concealed end of the door stop. This brace abuts the interior or concealed surface of drywall material of the other side of the wall. Forces imposed on the door stop are therefore borne by two different panels of drywall, thereby reducing maximum loads imposed on any one panel of drywall. This is significant since drywall has much less strength than other building materials employed for walls.

The novel door stop absorbs and cushions forces from a swung door by a spring and also pneumatically. The spring stores forces, converting a negligible amount of kinetic energy into heat. By contrast, the pneumatic feature is very important in dissipating energy from the door and door stop. It is double acting, in that it resists rapid movement of a piston occupying the pneumatic pressure chamber of the door stop as a swung door collides with the door stop, and also resists unrestrained, rapid rebound of the piston during the return stroke. Dissipation of energy is thus spread out over time, which is an important principle in countering damage from rapid or violent collisions.

The present invention is suitable for repairs of damaged walls since it is readily installed through a hole left following a collision between the door knob and wall. The flange conceals damage, if minor, which would otherwise be aesthetically objectionable, and which would impair strength of the wall. The novel door stop imparts a finished appearance to a wall with remarkably little labor of repair. It is relatively inconspicuous since it is virtually flush with the finished wall.

Accordingly, it is one object of the invention to provide a door stop which dissipates energy of a swung door.

It is another object of the invention that the door stop conceal minor damage to the wall.

It is a further object of the invention that the door stop distribute force of impacts over both the damaged drywall panel of the wall and also over the opposed drywall panel of the wall.

Still another object of the invention is that the door stop be flush with the wall.

An additional object of the invention is that the door stop be readily installed in a wall.

It is again an object of the invention to be suitable for repairing walls damaged by impacts from door handles.

Yet another object of the invention is to impose minimal aesthetic impact on walls provided with door stops.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
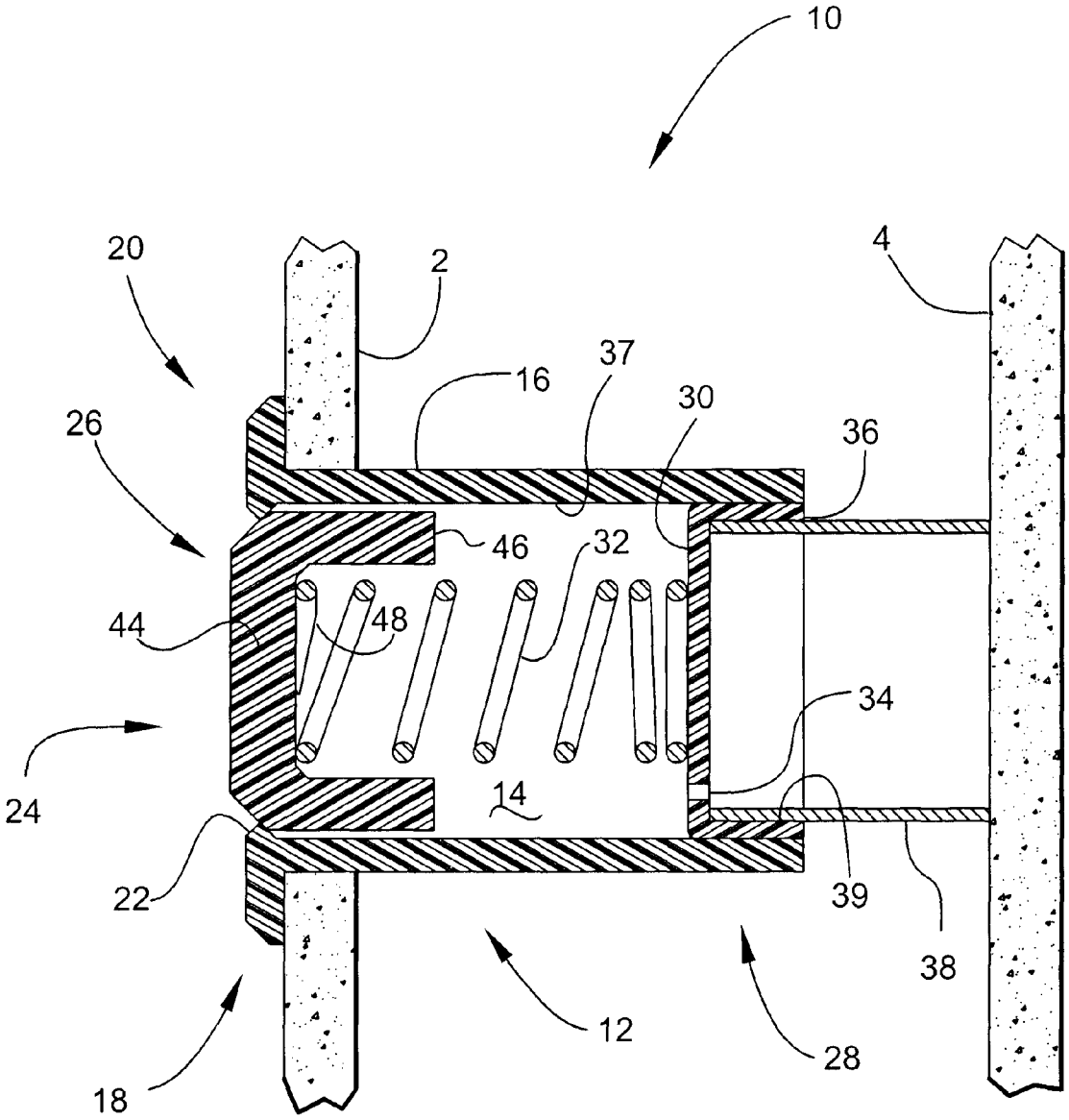
FIG. 1 is an environmental, side elevational, cross sectional view of the invention.

Turning now to FIG. 1 of the drawings, door stop 10 is shown mounted in a wall on which a door (not shown) is pivotally mounted. Door stop 10 is intended for hollow walls having a first drywall panel 2 and a second drywall panel 4. Drywall panel 2 is that which faces the door knob when the door is swung open. Door stop 10 comprises a hollow housing 12 enclosing a chamber 14. Housing 12 is bounded by a lateral wall 16. Housing 12 has a first end 18 bearing an externally projecting flange 20. An internal projection 22 is disposed at first end 18. A central opening 24 is formed at first end 18, although in the view of FIG., opening 24 is closed by a piston 26. Housing 12 has a rear end 28 which is closed by a rear wall 30.

Piston 26 is dimensioned and configured to occupy chamber 14, and is disposed in close yet slidable cooperation therewith. When a door knob (not shown) is swung into drywall panel 2, the impact is borne by piston 26, which then slides backwardly within chamber 14 in the direction of drywall panel 4. This motion will open forward end 18 of housing 12.

Energy of the impact is transferred to a coil spring 32 disposed between piston 26 and rear wall 30 of housing 12. Air compressed within chamber 14 is discharged through an air escape passage 34 disposed to enable air to flow into and out of chamber 14 responsive to movement of piston 26. After kinetic energy of the door is dissipated, spring 32 will urge piston 26 back to the original position shown in FIG. 1. The return stroke of piston 26 which returns piston 26 to the original position will induce a partial vacuum within chamber 14. Air re-enters chamber 14 through air escape passage 34. Thus piston motion in both directions is pneumatically dampened.

Rear wall 30 of housing 12 is preferably fabricated from a cup having a flat base panel which serves as rear wall 30 of chamber 14, and an upstanding perimetric wall 36 projecting to the rear of housing 12. The cup is dimensioned and configured to engage and be retained by the interior surface 37 of housing 12 by friction.

Figure 2:
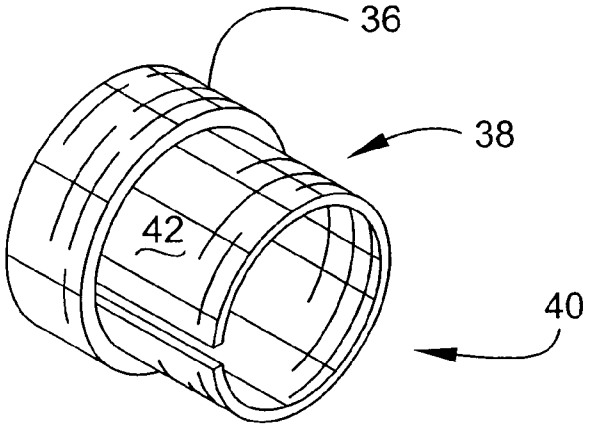
FIG. 2 is a perspective detail view of the right of FIG. 1.

A brace 38 is attached to housing 12 at rear end 28 of housing 12. In the preferred embodiment, brace 38 is a split cylinder which is C-shaped when viewed in end cross section. The nature of brace 38 is shown in FIG. 2. It will be appreciated that air expelled from chamber 14 following impact of the door knob with piston 26 passes to the interior of the wall through gap 40 formed in brace 38. Brace 38 is formed from a material disposed to expand radially, thereby maintaining contact of the external surface 42 with interior surface 39 of wall 36 of the cup closing chamber 14. Brace 38 is thus removably attached to housing 12.

Returning to FIG. 1, piston 26 has a floor 44 and an upstanding perimetric wall 46 projecting towards the rear of housing 12. Spring 32 is a coil spring dimensioned and configured to engage piston 26 by occupying the opening formed at the rear of piston 26, wherein one end 48 of spring 32 seats within piston 26, and is disposed inside wall 46, abutting floor 44 of piston 26.

Figure 3:
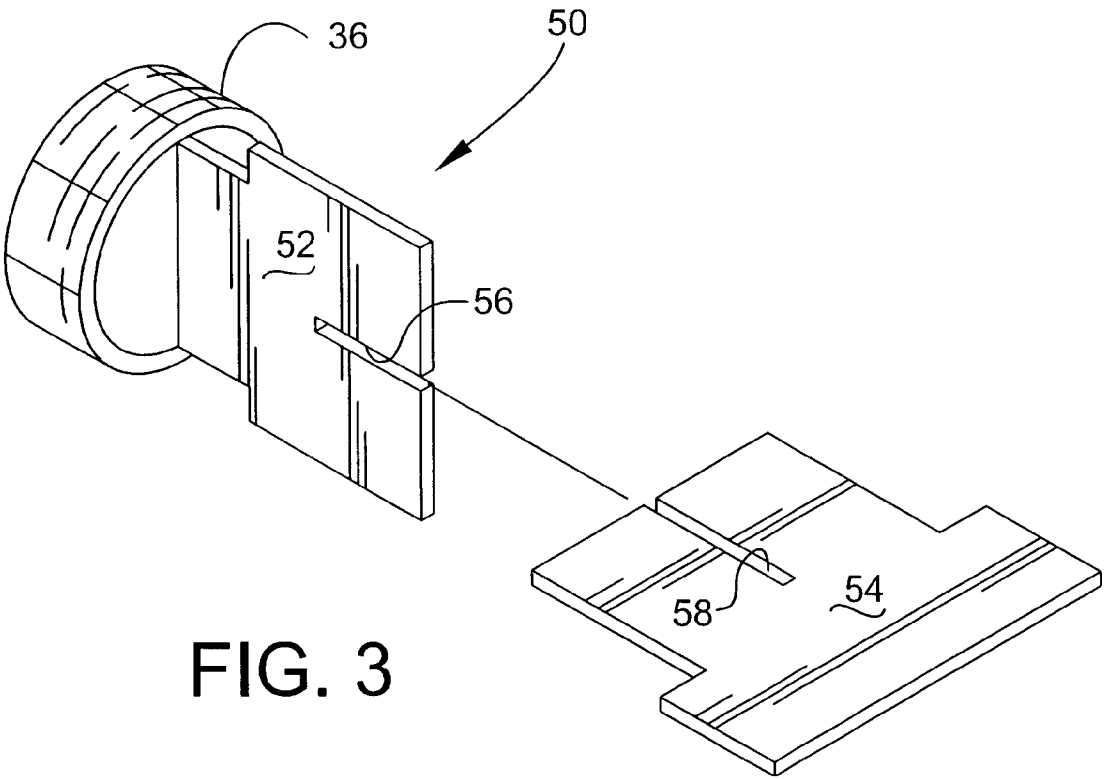
FIG. 3 is an exploded perspective detail view showing an alternative embodiment of the component shown in FIG. 2.

FIG. 3 illustrates an alternative embodiment of the invention wherein a brace 50 is cruciform when viewed in end cross section. Brace 50 is formed from two interfitting, separable parts 52, 54 which mate by sliding each part 52 or 54 into a corresponding slot 56 or 58 formed in the other part 52 or 54.

It should be noted that door stop 10 need not require a carefully cut hole to be installed in a wall. In fact, door stop 10 may be installed in a wall after a hole has been formed by collisions between a door knob and the wall. Flange 20 is sufficiently large so that in some cases, an irregular hole will be sufficiently covered such that no repair need be made to the wall to successfully install door stop 20 in a pre-existing hole. In other cases, an existing hole may be enlarged sufficiently to insert housing 12 thereinto. In other cases, an existing hole may be patched so that it corresponds closely to the diameter of housing 12.

Brace 38 or 50 can be planed or abraded such that it contacts rear drywall panel 4 when door stop 10 is inserted until flange 20 abuts drywall panel 2. Braces 38, 50 are removably attached to wall 36 of the cup closing chamber 14 at the rear so that each may be renewed and adjusted to suit.

Housing 12, piston 26, and the cup closing chamber 14 are preferably formed from a synthetic resin, such as acrylonitrile butadiene styrene (ABS) or another suitable material. Brace 38 is preferably made from spring steel. However, other materials enabling performance as described above may be substituted if desired.

The present invention is susceptible to variations and modifications which may be introduced without departing from the inventive concept. For example, air passage 34 may be formed in housing 12 if not in the cup closing chamber 14. Alternatively, clearance between surface 37 of housing 12 and piston 26 may be of magnitude to be the equivalent of air passage 34.

In addition, the general cross section of the piston, housing, etc, may be elliptical or otherwise elongated in the vertical direction so as to accommodate vertical handle type door openers.

It is to be understood that the present invention is not limited to the embodiments described above, but encompasses any and all embodiments within the scope of the following claims.

I claim:

1. A door stop, in combination with the knob of a pivotally mounted door, for installation in a vertical partition proximate said door, said door stop comprising:

a) a hollow housing adapted for mounting in a vertical partition and enclosing a chamber, said housing having a lateral wall, a first end bearing an externally projecting flange adapted for securing said housing to said partition, an internal projection, a central opening, and a rear wall forming a closed rear end;

b) a piston dimensioned and configured to occupy a forward portion of said chamber proximate said flange of said housing, said piston disposed in close yet slidable cooperation therewith and retained therein by said internal projection;

c) a spring disposed between said piston and said rear wall of said housing, said spring disposed to urge said piston towards said first end of said housing; and d) an air escape passage disposed in a wall of said housing to enable air to controllably flow into and out of said chamber responsive to movement of said pistons;

whereby as said knob of said door moves in an arcuate path about hinges of said door, said knob of said door may impact said piston thereby compressing said spring and air within said housing to mechanically and pneumatically dampen the rearward movement of said piston and absorb kinetic energy from said pivoting door imparted to said piston by said knob.

2. The door stop according to claim 1, wherein said rear wall is a cup having a flat base panel and an upstanding perimetric wall projecting to the rear of said housing, and said cup is dimensioned and configured to engage and be retained by the interior surface of said housing by friction.

3. The door stop as recited in claim 1, further comprising:

e) a brace attached to said housing proximate said rear end.

4. The door stop according to claim 3, wherein said brace is a split cylinder which is C-shaped when viewed in end cross section, and wherein said brace is formed from a material disposed to expand radially, thereby maintaining contact with interior surfaces of said perimetric wall of said cup.

5. The door stop according to claim 2, wherein said brace is cruciform when viewed in end cross section.

6. The door stop according to claim 5, wherein said brace is formed from two interfitting, separable parts.

7. The door stop according to claim 1, wherein said piston has a floor and an upstanding perimetric wall projecting towards the rear of said housing, and said spring is a coil spring dimensioned and configured to engage said piston by occupying said piston, wherein one end of said spring seats within said piston, and is disposed inside said perimetric wall and abuts said floor of said piston.

8. A door stop, in combination with the knob of a pivotally mounted door, for installation in a wall proximate said door, said door stop comprising:

a) a hollow housing adapted for mounting in a wall and enclosing a chamber, said housing having a lateral wall, a first end bearing an externally projecting flange adapted for securing said housing in said wall, an internal projection, and a central opening, and a rear wall forming a closed rear end, wherein said rear wall comprises at least one of: a cup having a flat base panel and an upstanding perimetric wall projecting to the rear of said housing, said cup being dimensioned and configured to engage and be retained by the interior surface of said housing by friction, and a disk;

b) a piston dimensioned and configured to occupy a forward portion of said chamber of said housing, said piston disposed in close yet slidable cooperation therewith, said piston being retained within said chamber by said internal projection and being adapted to intercept said knob; and c) a spring disposed between said piston and said rear wall of said housing, said spring disposed to urge said piston towards said first end of said housing, wherein said piston has a floor and an upstanding perimetric wall projecting towards the rear of said housing, and said spring is a coil spring dimensioned and configured to engage said piston by occupying said piston, wherein one end of said spring seats within said piston, and is disposed inside said perimetric wall and abuts said floor of said piston; whereby as said knob of said door moves in an arcuate path about hinges of said door, said knob of said door may impact said piston thereby compressing said spring and air within said housing to both mechanically and pneumatically dampen the rearward movement of said piston and absorb kinetic energy from said pivoting door imparted to said piston by said knob.

9. The door stop as recited in claim 1, wherein said air escape passage is disposed in said rear wall of said housing.

10. The door stop as recited in claim 1, wherein said air escape passage comprises a space between an outer surface of said piston and an inner surface of said housing.

11. An apparatus, in combination with a vertical partition proximate a pivotally mounted door having a door knob, for intercepting the travel of said knob and dissipating the kinetic energy thereof, comprising:

a) a hollow cylinder adapted for mounting within said substantially vertical, hollow partition comprising a first planar member proximate said pivoting door and a second, spaced apart planar member, said cylinder having an open front end, a closed rear end, a substantially solid perimetric wall therebetween, an external annular flange fixedly attached to and concentric with said cylinder and disposed at said open front end thereof, said annular flange having an outer surface and an inner surface, said inner surface being adapted to engage the outside surface of said first planar member of said partition, said flange having an outside diameter suitable for concealing damage to said partition;

b) a piston disposed in said cylinder and having a front surface, a rear surface, and a diameter substantially the same as the inside diameter of said cylinder and slidable therewithin, a portion of said front surface projecting a predetermined distance beyond said outer surface of said annular flange when said piston is in a first, operational position within said cylinder;

c) a spring disposed between said rear surface of said piston and said closed rear end of said cylinder to urge said piston into said first, operational position; and d) an air escape passage disposed in said cylinder behind said piston and sized to allow air to flow at a predetermined, controlled rate into and out of said cylinder in response to movement of said piston therein;

whereby said door knob striking said projecting portion of said piston displaces said piston rearwardly into said cylinder thereby compressing said spring and air within said cylinder in a region between said rear surface of said piston and said closed rear end of said cylinder and forcing said compressed air out of said cylinder through said air escape passage at said predetermined, controlled rate thereby both mechanically and pneumatically damping the rearward motion of said piston within said cylinder thereby absorbing kinetic energy from said door without damage to said partition by said knob of said pivoting door.

12. The apparatus as recited in claim 11, wherein said partition comprises a partition having a previously damaged region caused by said door knob impacting said partition, whereby said previously damaged region may be hidden by said flange when said apparatus is installed in said partition at the point of said previously damaged region and further damage to said region prevented by said apparatus.

* * * * *